US005311439A

United States Patent [19]

Hayakawa et al.

[11] Patent Number: 5,311,439

[45] Date of Patent: May 10, 1994

[54] EMBROIDERY DATA PROCESSING SYSTEM AND METHOD

[75] Inventors: Atsuya Hayakawa, Chita; Kyoji Komuro, Nagoya, both of Japan

[73] Assignee: Brother Kogyo Kabushiki Kaisha, Nagoya, Japan

[21] Appl. No.: 874,081

[22] Filed: Apr. 27, 1992

[30] Foreign Application Priority Data

Jul. 16, 1991 [JP] Japan ..... 3-201375

[51] Int. Cl.[5] ..... G06F 15/46; D05B 21/00

[52] U.S. Cl. ..... 364/470; 112/121.12; 112/266.1; 112/457

[58] Field of Search ..... 364/470, 188, 189, 191-193; 112/121.11, 121.12, 121.13, 266.1, 103, 453-458, 80.23

[56] References Cited

U.S. PATENT DOCUMENTS 4,982,674 1/1991 Hayakawa ..... 112/121.12
4,991,524 2/1991 Ozaki ..... 364/470 X
5,054,408 10/1991 Hayakawa ..... 364/470 X
5,179,520 1/1993 Hayakawa ..... 364/470
5,181,176 1/1993 Hayakawa ..... 364/470
5,189,622 2/1993 Hayakawa et al. ..... 364/470

FOREIGN PATENT DOCUMENTS 62-2556 1/1987 Japan .
3-128084 5/1991 Japan .

*Primary Examiner*—Joseph Ruggiero
*Attorney, Agent, or Firm*—Oliff & Berridge

[57] ABSTRACT

Contour data representing the contour of an embroidering area to be covered up with stitches formed by an embroidery machine is read from a contour data storage means and the contour of the embroidering area is displayed on a display on the basis of the contour data. A desired stitching direction for at least one point in the embroidering area is specified by the operator. The embroidering area is divided into a plurality of embroidering sections by dividing line segments parallel to the specified desired stitching direction. A reference point is set for each embroidering section. Each embroidering section is divided into blocks so that the respective contours of all the blocks are convex, and then embroidery data is produced.

20 Claims, 26 Drawing Sheets

Fig.2B

| ITEM | INSTRUCTIONS |
|---|---|
| 24 | NEEDLE SELECTOR MOTOR |
| 26 | MAIN MOTOR |
| 38 | WORK FEED MECHANISM |
| 46 | I/O PORT |
| 48 | DRIVING CIRCUIT |
| 50 | DRIVING CIRCUIT |
| 52 | DRIVING CIRCUIT |
| 54 | EXTERNAL STORAGE DEVICE |
| 56 | INPUT CONTROL CIRCUIT |
| 58 | INPUT DEVICE |
| 60 | DISPLAY CONTROL CIRCUIT |
| 62 | DISPLAY |

Fig.4B

| ITEM | INSTRUCTIONS |
|---|---|
| S1 | READ CONTOUR DATA |
| S2 | DISPLAY EMBROIDERING AREA |
| S3 | SET DESIRED STITCHING LINE SEGMENTS |
| S4 | DIVIDE EMBROIDERING AREA BY STITCH DIVIDING LINE SEGMENTS |
| S5 | DETERMINE REFERENCE POINT |
| S6 | DIVIDE EMBROIDERING SECTIONS BY USING INVERTING POINTS |
| S7 | PRODUCE EMBROIDERY DATA |
| S8 | STORE EMBROIDERY DATA IN THE EXTERNAL STORAGE DEVICE |

Fig.5B

| ITEM | INSTRUCTIONS |
|---|---|
| S21 | SET ONE OF THE EXTREME POINTS OF A DESIRED STITCHING LINE SEGMENT |
| S22 | SET THE OTHER EXTREME POINT OF THE DESIRED STITCHING LINE SEGMENT |
| S23 | PROPER DESIRED STITCHING LINE SEGMENT ? |
| S24 | STORE DESIRED STITCHING LINE SEGMENT IN THE DESIRED STITCHING LINE DATA STORAGE AREA |
| S25 | INCREMENT THE DESIRED STITCHING LINE NUMBER BY ONE |
| S26 | HAS DESIRED STITCHING LINE SEGMENT SETTING OPERATION BEEN COMPLETED ? |

Fig.6B

| ITEM | INSTRUCTIONS |
|---|---|
| S31 | PUT FIRST EMBROIDERING SECTION IN DIVISION STACK |
| S32 | IS DIVISION STACK EMPTY ? |
| S33 | DETERMINE DATA STORING SEQUENCE |
| S34 | ARE THERE ANY VERTICES WHERE THE CONTOUR IS INVERTED OUTWARD ? |
| S35 | DIVIDE FIRST EMBROIDERING SECTION |
| S36 | PUT EMBROIDERING SECTIONS IN DIVISION STACK |
| S37 | STORE FIRST EMBROIDERING SECTIONS IN EMBROIDERING SECTION DATA STORAGE AREA |

Fig.7B

| ITEM | INSTRUCTIONS |
|---|---|
| S41 | FETCH SECOND EMBROIDERING SECTIONS |
| S42 | DRAW STRAIGHT LINES $LP_i$ PASSING THE REFERENCE POINT O AND THE VERTICES $P_i$ |
| S43 | DETERMINE TWO PARTIAL CONTOURS |
| S44 | DIVIDE SECOND EMBROIDERING SECTION INTO BLOCKS |
| S45 | STORE BLOCK DATA |
| S46 | ARE THERE MORE SECOND EMBROIDERING SECTIONS ? |

Fig.8B

| ITEM | INSTRUCTIONS |
|---|---|
| 90 | CONTOUR DATA STORAGE DEVICE |
| 92 | EMBROIDERING AREA DISPLAYING DEVICE |
| 94 | DESIRED STITCHING LINE SEGMENT SETTING DEVICE |
| 96 | EMBROIDERY DATA PRODUCING DEVICE |
| 98 | EMBROIDERY DATA STORAGE DEVICE |
| 100 | FIRST DIVIDING DEVICE |
| 106 | SECOND DIVIDING DEVICE |
| 108 | BLOCKING DEVICE |

Fig.16

| CONTOUR DIVISION DECISION TABLE | | POSITION OF POINT $P_{s+1}$ WITH RESPECT TO A STRAIGHT LINE $L_b$ | |
|---|---|---|---|
| | | LEFT | RIGHT |
| CONTOUR | CLOCKWISE | EXTERNALLY CONCAVE | EXTERNALLY CONVEX |
| | COUNTERCLOCKWISE | EXTERNALLY CONVEX | EXTERNALLY CONCAVE |

EMBROIDERY DATA PROCESSING SYSTEM AND METHOD

BACKGROUND OF THE INVENTION

1. Field of the Invention

The invention relates to an embroidery data processing system for producing embroidery data necessary for embroidering a pattern of stitches in an embroidering area by a sewing machine and, more particularly, to improvements in producing proper embroidery data in respect of connection with the shape of a desired embroidering area.

2. Description of the Related Art

Embroidery data processing systems capable of automatically producing embroidery data necessary for embroidering a pattern of stitches in a desired embroidery area by a sewing machine on the basis of contour data representing the contour of the desired embroidery area have been proposed in U.S. Pat. No. 4,982,674 granted to the applicant of the present patent application, Japanese Patent Laid-open No. Hei 3-128084 filed by the applicant of the present patent application and Japanese Patent Publication No. Sho 62-2556.

The embroidery data processing system disclosed in U.S. Pat. No. 4,982,674 produces embroidery data taking into consideration a stitching direction specified by the operator, on the basis of data of the continuous contour of an embroidery area entered by the operator and the stitching direction specified by the operator. However, it is impossible to produce embroidery data for stitching stitches in all directions that are perfectly suitable for the shape of the embroidering area, because only one stitching direction can be specified.

The embroidery data processing system proposed in Japanese Patent Laid-open No. Hei 3-128084 divides the contour of an embroidering area, represented by data entered by the operator, into two opposite partial contours with respect to a direction perpendicular to an embroidering direction, estimates the direction of extension of the center line of the embroidering area from the shapes of the partial contours, divides the embroidering area into a plurality of blocks arranged in a line along the direction of extension of the center line, and produces embroidery data taking into consideration the respective shapes of the blocks. Accordingly, this embroidery data processing system is capable of automatically determining different stitching directions respectively for the blocks. Therefore, the direction of stitches formed according to the embroidery data produced by this embroidery data processing system is more suitable for the shape of the embroidering area than that of stitches formed according to the embroidery data produced by the embroidery data processing system disclosed in U.S. Pat. No. 4,982,674. However, the stitching direction determined by the embroidery data processing system does not always coincide perfectly with that desired by the operator and, since the embroidery data is produced only on the basis of the data representing the contour of the embroidering area, the embroidery data is not perfectly proper in respect of connection with the shape of the embroidering area.

The embroidery data processing system disclosed in Japanese Patent Publication No. Sho 62-2556 produces embroidery data taking into consideration a desired stitching direction when data representing the contours of a plurality of blocks of an embroidering area is entered and a desired stitching direction is specified for each block. Accordingly, different stitching directions corresponding to those desired by the operator are determined respectively for the blocks of the embroidering area. Therefore, stitches are formed in directions more appropriate for the shape of the embroidering area than those determined by the foregoing embroidery processing systems. However, this embroidery data processing system requires data individually representing the plurality of blocks of the embroidering area, and data representing stitching directions respectively for the plurality of blocks even if the desired stitching directions for the adjacent blocks are the same, which increases the instructional load on the operator

SUMMARY OF THE INVENTION

Accordingly, it is an object of the invention to provide an embroidery data processing system capable of determining a plurality of desired stitching directions for a plurality of blocks in an embroidering area and of producing perfectly appropriate embroidery data in respect of connection with the shape of the embroidering area.

An embroidery data processing system in one aspect of the present invention comprises: a contour data storage means for storing contour data representing the contour of a desired embroidering area in which stitches are formed in a pattern by a sewing machine; a contour display means for displaying the shape of the embroidering area represented by the contour data; a representative desired stitch setting means for setting the direction and position of representative stitches in the embroidering area displayed on the contour display means according to instructions given thereto by the operator; an embroidery data producing means for producing embroidery data necessary for forming stitches in a pattern in the embroidering area on the basis of stitch data representing at least one of the set representative stitches and the contour data; and embroidery data storage means for storing the embroidery data produced by the embroidery data producing means.

Although the representative desired stitch setting means is capable of setting a plurality of representative desired stitches for the embroidering area, the same may be either capable of setting a plurality of representative desired stitches and incapable of setting a single representative desired stitch or capable of setting a plurality of representative desired stitches and of a single representative desired stitch.

The embroidery data producing means of the embroidery data processing system includes an embroidering area dividing means for dividing the embroidering area into a plurality of embroidering sections by desired stitching line segments corresponding respectively to the representative desired stitches.

The embroidering area dividing means of the embroidery data producing means is a first dividing means for dividing the embroidering area into a plurality of first embroidering sections, i.e., the embroidering sections, and the embroidery data producing means includes the first dividing means, and a second dividing means for dividing each of the first embroidering sections into a plurality of second embroidering sections so that the contour of each second embroidering section is not externally concave on a plurality of straight lines including stitches to be formed on a plurality of contour determining points on the contour of each second embroidering section.

The second dividing means divides the first embroidering sections into the second embroidering sections by at least one straight line passing a reference point at which the extensions of the two stitching line segments corresponding to the first embroidering section intersect each other and at least one of the contour determining points of the first embroidering section so that the contours of the second embroidering sections are not inverted on a plurality of straight lines passing the reference point and the plurality of contour determining points.

The embroidery data producing means further includes a blocking means for dividing the embroidering section into a plurality of blocks by a plurality of straight lines passing the reference point at which the extensions of two desired stitching line segments intersect each other and the plurality of contour determining points.

The embroidery data producing means further includes a blocking means for dividing the embroidering section into a plurality of blocks by a plurality of straight lines passing a reference point at which the extension of a desired stitching line segment corresponding to each of the embroidering sections and a straight line determined by the desired stitching line segment and the contour of each embroidering section intersect each other and a plurality of contour determining points on the contour of the embroidering section.

The embroidery processing system has the representative desired stitch setting means capable of setting a plurality of representative desired stitches desired by the operator in the embroidering area according to instructions given thereto by the operator, that is, desired stitching directions can be determined for a plurality of portions of the embroidering area.

When the stitching directions of desired stitches to be formed in the embroidering area are substantially the same, one of the desired stitches is specified as a representative desired stitch and a desired stitching line segment is set. If the difference in stitching direction between the desired stitches is relatively large, the desired stitches differing from each other relatively greatly in stitching direction are specified as representative desired stitches. Accordingly, in either case, only representative desired stitches necessary for producing embroidery data are determined for the embroidering area to omit determining surplus representative desired stitches.

The embroidering area dividing means divides the embroidering area into a plurality of embroidering sections by the desired stitching line segments corresponding to the representative desired stitches determined by the representative desired stitch setting means. Thus, the embroidering area is divided into the embroidering sections in which the stitching direction scarcely changes or changes monotonously.

The first dividing means of the embroidery data processing system divides the embroidering area into the first embroidering sections at least by the single desired stitching line segment, and then the second dividing means divides the first embroidering sections. It is possible that the curvature of the contours of some of the first embroidering sections is relatively large. Accordingly, the second dividing means divides the first embroidering sections into the second embroidering sections so that the contours of the second embroidering sections are not externally concave on the straight line passing stitches to be formed at the contour determining points of the second embroidering sections.

The second dividing means of the embroidery data processing system divides the first embroidering sections into the second embroidering sections by using the reference points at which the extensions of the two desired stitching line segments, corresponding to each first embroidering section, intersect each other. Specifically, the first embroidering section is divided into the second embroidering sections by at least one straight line passing the reference point and at least one of the contour determining points of the first embroidering sections so that the contours of the second embroidering sections are not externally concave on the plurality of straight lines passing the reference point and the contour determining points of each second embroidering section.

The blocking means of the embroidery data processing system divides the embroidering sections divided by the embroidering area dividing means into the blocks by using the reference point at which the extensions of the two desired stitching line segments corresponding to the embroidering section intersect each other. Specifically, the embroidering section is divided into the blocks by the straight lines passing the reference point and the contour determining points of the embroidering sections.

The blocking means of the embroidery data processing system divides the embroidering sections divided by the embroidering area dividing means into the blocks by using the reference point determined on the basis of the direction and position of a representative desired stitch corresponding to the embroidering section and the contour of the embroidering section. Thus, the contour of the embroidering sections as well as the representative desired stitch is taken into consideration in dividing the embroidering section into the blocks.

As is apparent from the foregoing description, the present invention sets only a number of representative desired stitches necessary for producing the embroidery data for the embroidering area to omit unnecessary setting operations so that the operator is able to easily obtain embroidery data perfectly proper in respect of connection with the shape of the embroidering area.

BRIEF DESCRIPTION OF THE DRAWINGS

A preferred embodiment of the invention will be described in detail with reference to the following drawings, wherein:

FIG. 2B is a table of labels for the block diagram of FIG. 2A;

FIG. 4B is a table of labels for the flowchart of FIG. 4A;

FIG. 5B is a table of labels for the flowchart of FIG. 5A;

FIG. 6B is a table of labels for the flowchart of FIG. 6A;

FIG. 7B is a table of labels for the flowchart of FIG. 7A;

FIG. 8B is a table of labels for the block diagram of FIG. 8A;

FIG. 16 is a table of assistance in explaining step S6 of the embroidery data producing program of FIGS. 4A and 4B;

DETAILED DESCRIPTION OF THE PREFERRED EMBODIMENTS

Figure 1:
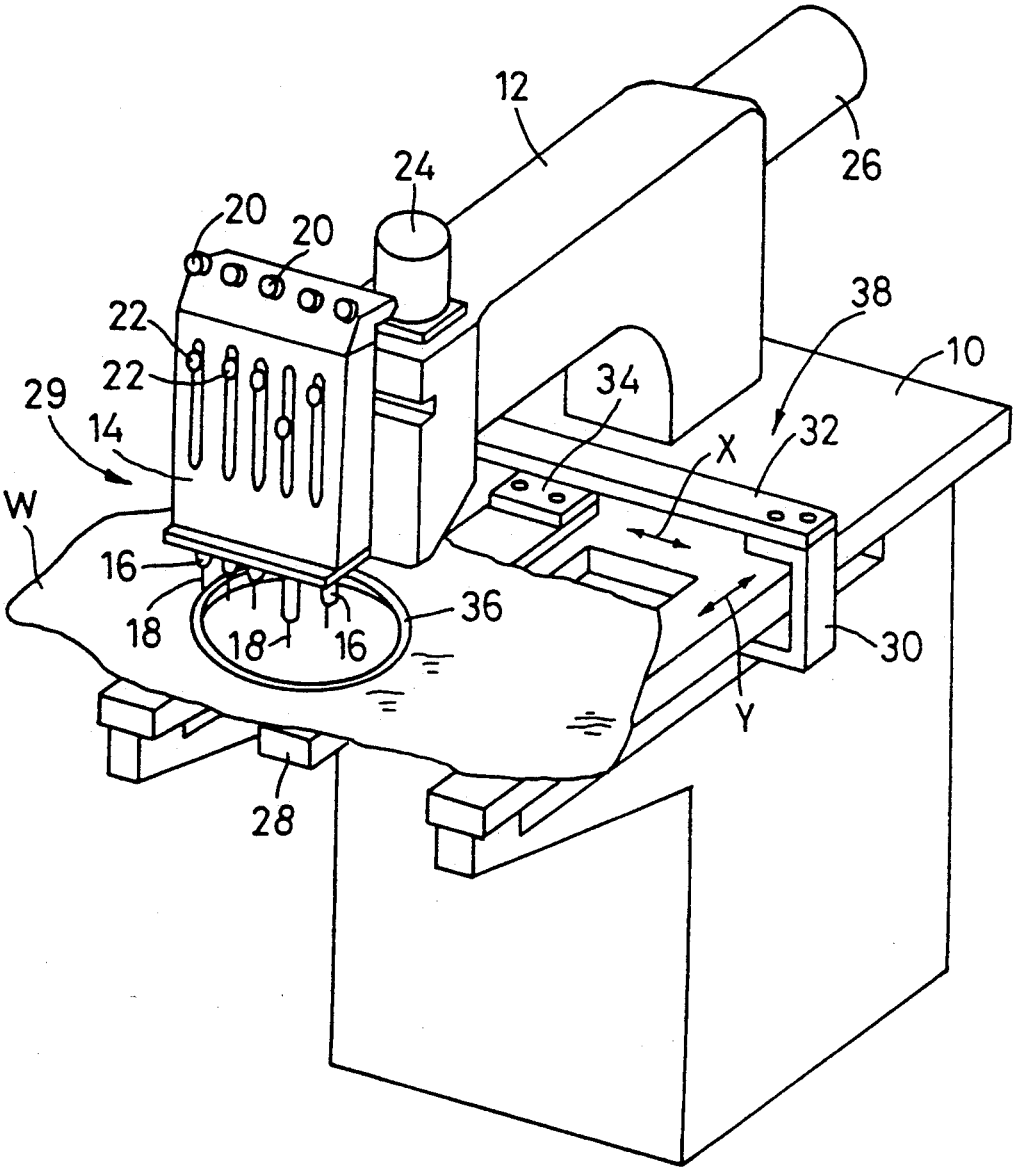
FIG. 1 is a perspective view of an automatic sewing machine incorporating an embroidery data processing system in a preferred embodiment according to the invention.

Referring to FIG. 1, a needle bar supporting member 14 is supported for lateral movement on the extremity of an arm 12 set on a table 10. Five needle bars 16 are supported for vertical reciprocation on the needle bar supporting member 14 and a needle 18 is held fixedly on the lower end of each needle bar 16. Threads of different types are fed from bobbins, not shown, through thread tension regulators 20 and thread take-up levers 22 to the needles 18, respectively. The needle bar supporting member 14 is driven by a needle selector motor 24 mounted on the arm 12 to locate a desired one of the needle bars 16 holding the needles 18 at a stitching position.

When located at the stitching position, the needle bar 16 is driven for vertical reciprocation through a power transmission mechanism by a main motor 26. A bed 28 is projected from the table 10 so that the extremity of the bed 28 lies opposite to the selected needle bar 16 at the stitching position. A looper, not shown, for forming a stitch on a work W in cooperation with the needle 18 is mounted on the extremity of the bed 28.

Two Y-axis moving members 30 (only one of them is shown in FIG. 1) are supported on the opposite sides of the table 10 for movement in directions of the arrows Y. The Y-axis moving members 30 are driven by a Y-axis motor, not shown, for movement by a desired distance in either of the directions of the arrows Y. A cross beam 32 is extended between the Y-axis moving members 30 and an X-axis moving member 34 is supported for movement in directions of the arrows X on the cross beam 32. The X-axis moving member 34 is driven for movement of a desired distance in either of the directions of the arrows X by an X-axis motor, not shown. An embroidery frame 36, for detachably holding the work W, is attached to the X-axis moving member 34. Thus, the embroidery frame 36 can be moved to an optional position in a X-Y plane. The Y-axis moving members 30, the cross beam 32, the Y-axis motor, the X-axis moving member 34, the X-axis motor and the embroidery frame 36 constitute a work feed mechanism 38.

Figure 2A:
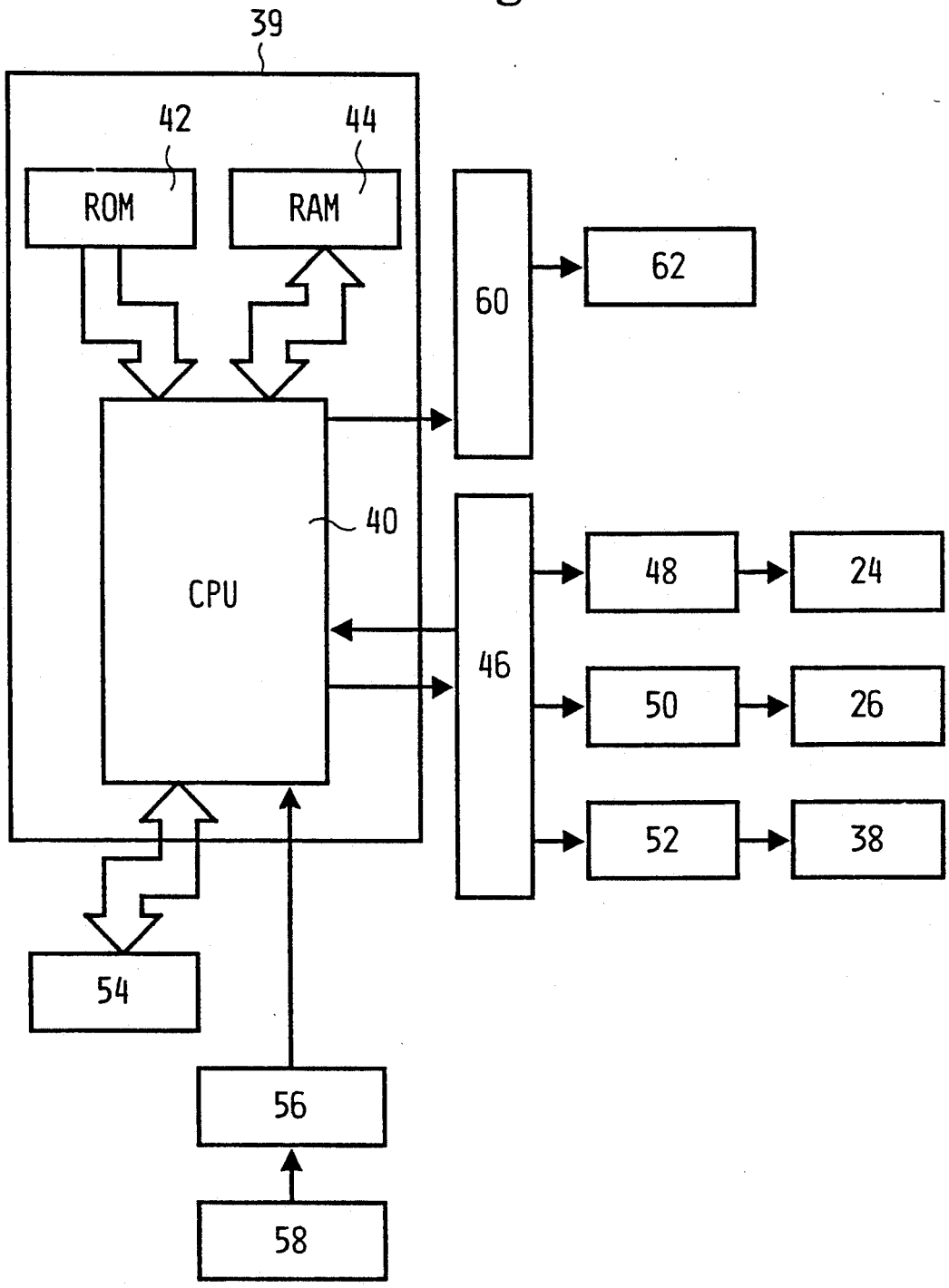
FIG. 2A is a block diagram of the control unit of the automatic sewing machine of FIG. 1.

Referring to FIG. 2, a control unit 39 for controlling the operation of the automatic sewing machine has a computer as a principal component. The computer comprises a CPU 40, a ROM 42 and a RAM 44. Driving circuits 48, 50 and 52 respectively, for driving the needle selector motor 24, the main motor 26 and the work feed mechanism, are connected through an I/O port 46 to the CPU 40. An external storage device 54, such as a magnetic tape recorder, for recording data, an input control circuit 56 and a display control circuit 60 are connected to the CPU 40. An input device 58 is connected to the input control circuit 56 and a display 62, such as a CRT, is connected to the display control circuit 60.

The input device 58 comprises a keyboard and a pointing device, such as a mouse. The operator operates the keyboard and the pointing device to store contour data representing the contour of an embroidering area, which is a polygon having a plurality of vertices in this embodiment. The contour data is a set of coordinates locating the vertices of the polygonal contour of the embroidering area on a plane defined by an X-Y coordinate system. The contour data is stored in the external storage device. The contour data may be entered by a method other than the method of using the keyboard. For example, the contour data may be entered by reading an original picture with an image scanner, automatically extracting the contour of the original picture from the output of the image scanner and producing the contour data for the contour of the original picture.

The operator is able to select a desired one of a plurality of embroidering areas stored in the external storage device 54, to specify a desired stitching direction, namely, to specify at least one desired stitching line segment, for at least one point in the desired embroidering area and to give a stitching start instruction by operating the input device 58.

The contour of the desired embroidering area, the embroidery data of the embroidery and the like are displayed on the display 62.

Figure 3:
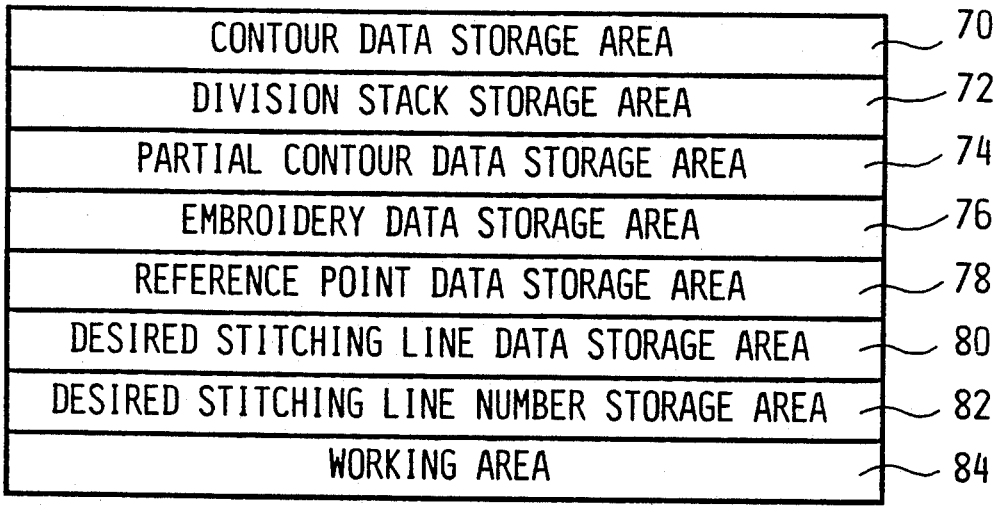
FIG. 3 is a diagram showing the construction of a RAM included in the control unit of FIG. 2.

Referring to FIG. 3, the RAM 44 has a contour data storage area 70, a division stack storage area 72 for storing the division stack to be used for dividing a first embroidering section into a plurality of second embroidering sections, a partial contour data storage area 74, an embroidery data storage area 76, a reference point data storage area 78, a desired stitching line data storage area 80, a desired stitching line number storage area 82 and a working area 84. The ROM 42 stores control programs for controlling the operation of the automatic sewing machine and the embroidery data producing program shown in FIGS. 4A and 4B, 5A and 5B, 6A and 6B and 7A and 7B.

Figure 8A:
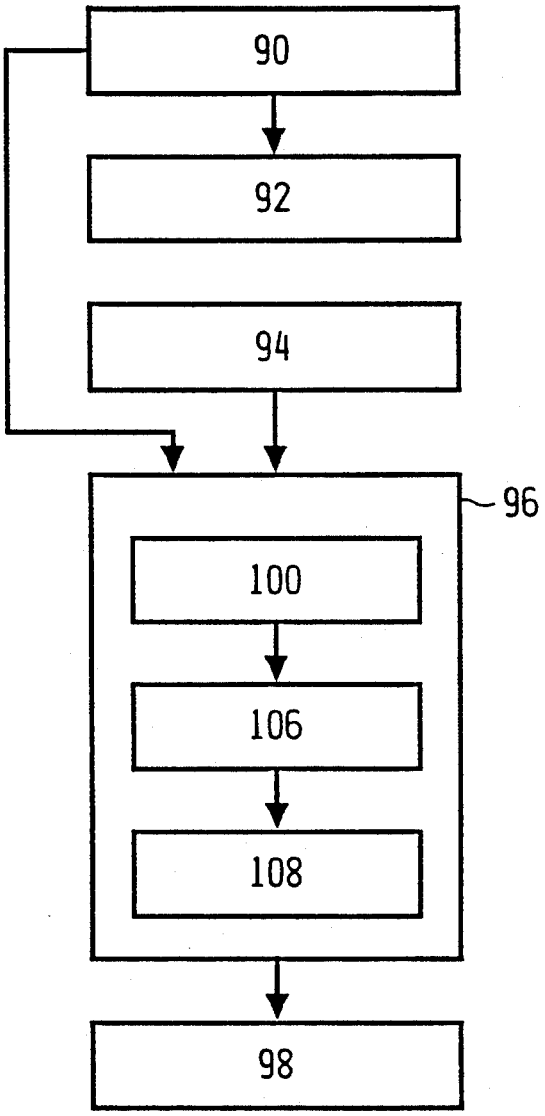
FIG. 8A is a block diagram of an embroidery data processing system incorporated into the automatic sewing machine of FIG. 1.

As shown in FIGS. 8A and 8B, the control unit 39 is provided with a contour data storage device 90, an embroidering area displaying device 92, a desired stitching line segment setting device 94, an embroidery data producing device 96 and an embroidery data storage device 98 for producing the embroidery data.

The contour data storage device 90 stores contour data representing the contour of an embroidering area and has a portion of the computer program for executing step S1 (FIGS. 4A and 4B) and the contour data storage area 70 of the RAM 44.

The embroidering area displaying device 92 displays the contour of a desired embroidering area chosen from among the previously stored embroidering areas on the display 62. The embroidering area displaying device 92 has a part for executing step S2 (FIGS. 4A and 4B), the display control circuit 60 and the display 62.

The desired stitching line segment setting device 94 is capable of setting the position and direction of a desired stitching line segment corresponding to each of the representative desired stitches among desired stitches to be formed in the embroidering area by the automatic sewing machine. Desired stitching directions can be set for a plurality of points in the embroidering area. The desired stitching line segment setting device 94 has a part for executing step S3 (FIGS. 4A and 4B), the desired stitching line data storage area 80, the desired stitching line number storage area 82, the input control circuit 56 and the input device 58.

The desired stitching line segment setting device 94 is capable of setting both a single desired stitching line segment and a plurality of desired stitching line segments for the embroidering area. However, the desired stitching line segment setting device 94 may be capable of only setting a plurality of desired stitching line segments for the embroidering area.

The embroidery data producing device 96 produces embroidery data necessary for forming stitches in the embroidery area on the basis of the desired stitching line data representing at least one desired stitching line segment and the contour data representing the contour of the embroidery area. The embroidery data producing device 96 is provided with a first dividing device 100, a second dividing device 106 and a blocking device 108.

Figure 4A:
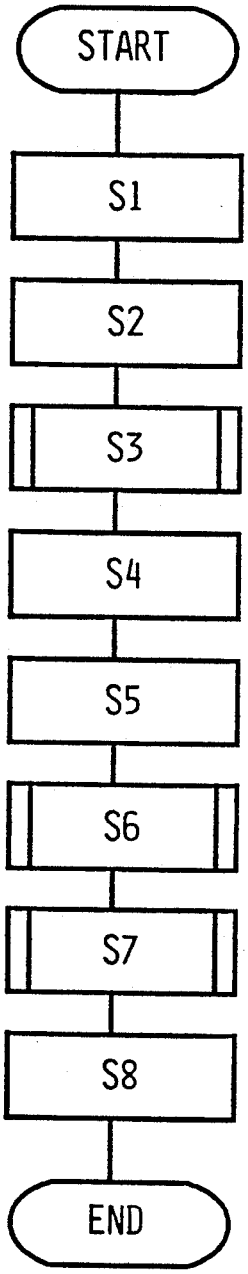
FIG. 4A is a flow chart of an embroidery data producing program stored in the ROM of the control unit of FIG. 2.

The first dividing device 100 divides the embroidering area into a plurality of first embroidering sections each with at least one desired stitching line segment. The first dividing device 100 has a part for executing step S4 (FIGS. 4A and 4B).

The second dividing device 106 is provided with a reference point determining device, an inverting point deciding device and a dividing device.

The reference point determining device determines a reference point corresponding to the first embroidering section by using at least one desired stitching line segment corresponding to each first embroidering section. The reference point determining device is provided with a part for executing step S5 (FIGS. 4A and 4B) and a part serving as the reference point data storage area 78 of the RAM 44. The embroidery data producing device 96 produces embroidery data necessary for covering the embroidering area with a plurality of radial stitches on an assumption that the plurality of desired stitches to be formed in the first embroidering section coincide substantially with some of the plurality of stitches extending radially from a central point. The central point corresponds to the reference point.

The inverting point deciding device decides whether or not the vertices of the first embroidering section are points where the first embroidering section is externally concave on straight lines passing the reference point and the vertices.

The dividing device divides the first embroidering section by at least one straight line passing the reference point and the vertex which is decided to be an inverting point into a plurality of second embroidering sections so that none of the vertices of the second embroidering sections is an inverting point. The dividing device has a part for executing step S6 (FIGS. 4A and 4B) and a part serving as the division stack storage area 72 of the RAM 44.

The blocking device 108 divides the second embroidering sections into a plurality of quadrangular blocks by a plurality of straight lines passing the reference point and the vertices of the second embroidering section and produces block data defining the quadrangular blocks as embroidery data. The blocking device 108 has a part for executing step S7 (FIGS. 4A and 4B). Since the blocking device 108 divides the second embroidery segment by the plurality of straight lines extending from the reference point, the first embroidering section is divided into the second embroidering sections so that none of the contours of the second embroidering sections are externally concave, namely, so that each of the straight lines intersects the contour of the second embroidering section at one point or two points to prevent forming abnormal blocks by the intersection of each straight line and the contour of the second embroidering section at three or more points.

The embroidery data produced by the embroidery data producing device 96 is stored in the embroidery data storage device 98. The embroidery data storage device 98 has a part for executing step S8 (FIGS. 4A and 4B) and a part serving as the embroidery data storage area 76 of the RAM 44.

Figure 9:
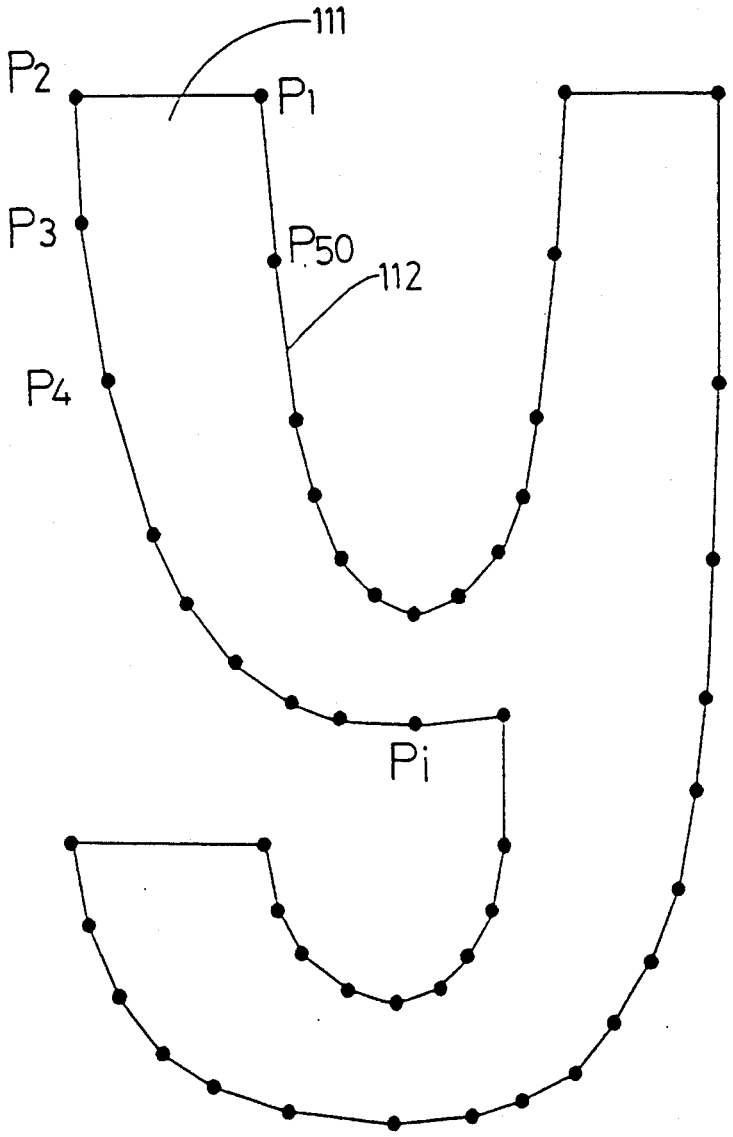
FIG. 9 is a diagram showing an embroidering area.

An embroidery data producing procedure for producing embroidery data, for example, for an embroidering area 111 shown in FIG. 9 will be described hereinafter with reference to FIGS. 4A and 4B to 7A and 7B.

FIGS. 4A and 4B are a flow chart, and a table of labels for the flow chart, of a main routine for carrying out the embroidery data producing procedure.

When an embroidery data producing instruction is given by the operator, the contour data representing the contour of the embroidering area 111 is fetched from the external storage device 54 and the contour data is stored in the contour data storage area 70 of the RAM 44 in step In step S2, the contour 112 of the embroidering area 111 is displayed on the display 62 on the basis of the contour data. As shown in FIG. 9, the contour 112 of the embroidering area 111 is formed by sequentially connecting vertices Pi (i=1, 2, . . . , and 50) with straight or curved lines.

In step S3, the operator sets a stitching direction at least at one point in the embroidering area 111. The direction and position of at least one desired stitching line segment is set for the embroidering area 111. If the stitching directions of stitches to be formed in the embroidering area 111 are substantially the same, a single desired stitching line segment is set. If the stitching directions of the stitches differ from each other in a relatively wide range of directions, a plurality of desired stitching line segments defining the plurality of desired stitches are set.

Figure 5A:
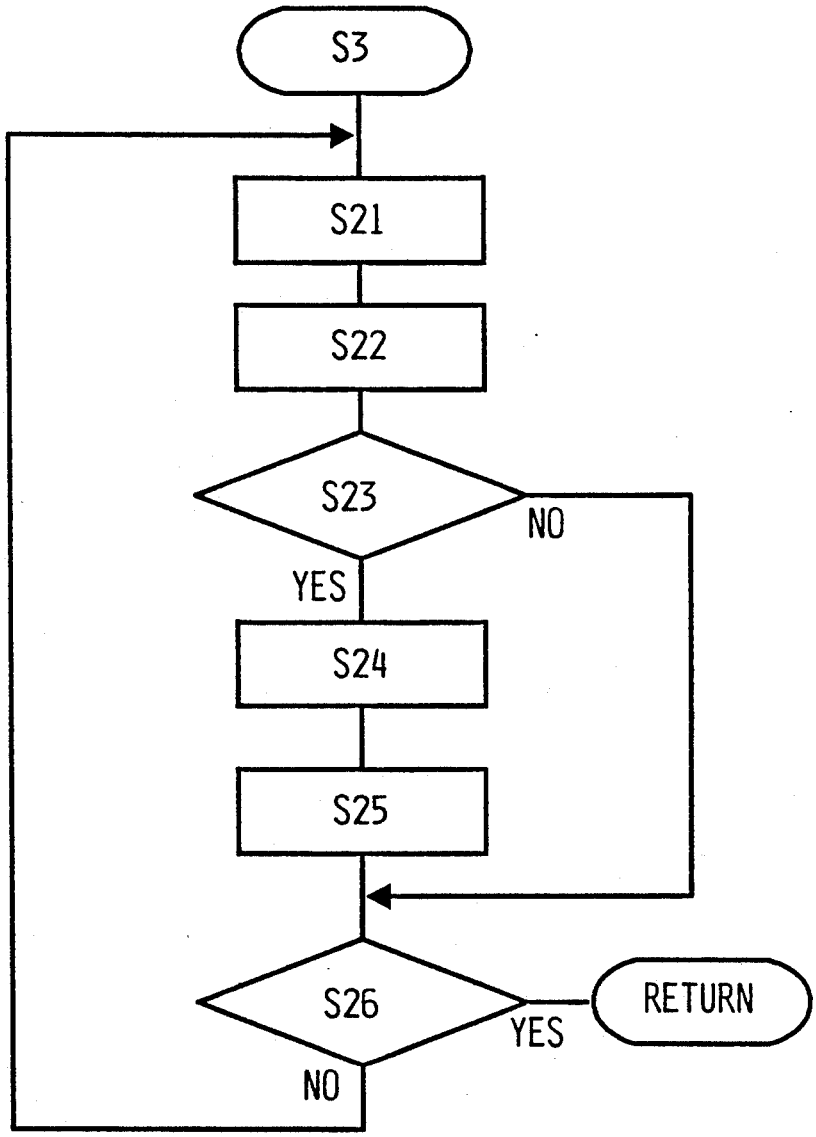
FIG. 5A is a flow chart of a subroutine to be executed in step S3 in the embroidery data producing program of FIGS. 4A and 4B.

FIG. 5A is a flow chart, and FIG. 5B a table of labels, of a subroutine to be executed in step S3 of the main routine shown in FIGS. 4A and 4B.

Referring to FIGS. 5A and 5B, one of the two extreme points of a desired stitching line segment is determined in step S21 and the other extreme point is determined in step S22 by means of a pointing device, such as a mouse. The two extreme points are two vertices among those defining the contour 112 of the embroidering area 111. Thus, in steps S21 and S22, two vertices among the vertices Pi corresponding to the two extreme points of a desired stitching line segment are selected.

Figure 10:
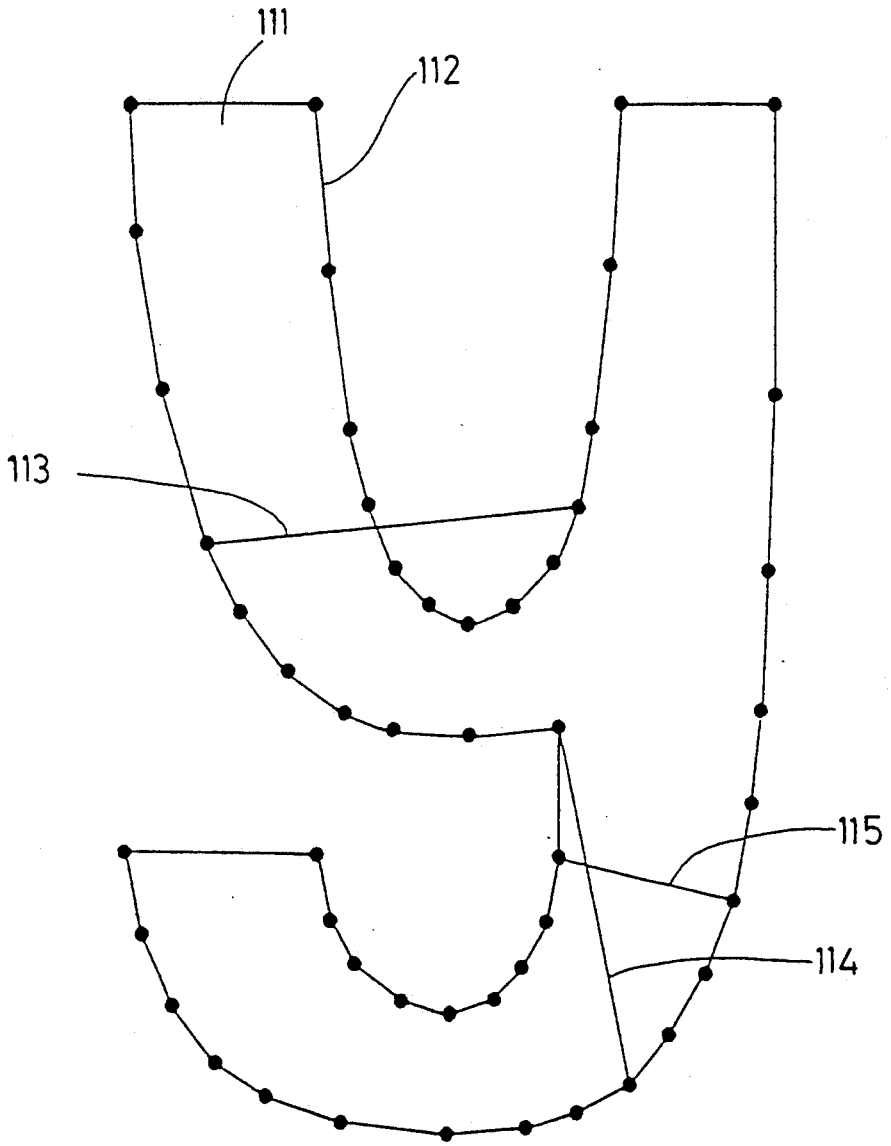
FIG. 10 is a view of assistance in explaining step S3 of the embroidery data producing program of FIGS. 4A and 4B.

In step S23, a query is made to see if the desired stitching line segment is proper, namely, if the desired stitching line segment is included in the embroidering area 111 and does not intersect a previously set desired stitching line segment. For example, a desired stitching line segment 113 shown in FIG. 10, having a portion extending outside the embroidering area 111, is not a proper desired stitching line segment. Likewise, a desired stitching line segment 114, intersecting a previously set desired stitching line segment 115, is not a proper desired stitching line segment.

If the response in step S23 is affirmative, desired stitching line data representing the desired stitching line segment is stored in the desired stitching line data storage area 80 in step S24. In step S25, the number of the desired stitching line segments stored in the desired stitching line number storage area 82 is incremented by one. If the response in step S23 is negative, the desired stitching line segment setting operation is ignored and a query is made in step S26 to see if a desired stitching line segment setting operation end instruction is entered. If the response in step S26 is negative, the routine returns to step S21 and if the response in step S26 is affirmative, the routine goes to step S4 of the main routine shown in FIGS. 4A and 4B.

Thus, one desired stitching line segment is set by choosing two vertices among the plurality of vertices of the embroidering area 111. The two vertices may be either the two adjacent vertices or one vertex. The purpose of choosing one vertex will be described later.

The direction and position of the desired stitching line segment can be determined by a single step operation by the operator. The direction and position can be determined individually. For example, the direction may be determined by setting two points outside the embroidering area 111 displayed on the display 62 by using the pointing device to create a vector, and then, the position of the desired stitching line segment, or segments, may be set within the embroidering area 111 by indicating a start point on the outline and where the vector intersects the opposing outline defines a desired stitching line segment therebetween and vice versa. Thus, multiple desired stitching line segments may be defined by designating a plurality of start points.

Figure 11:
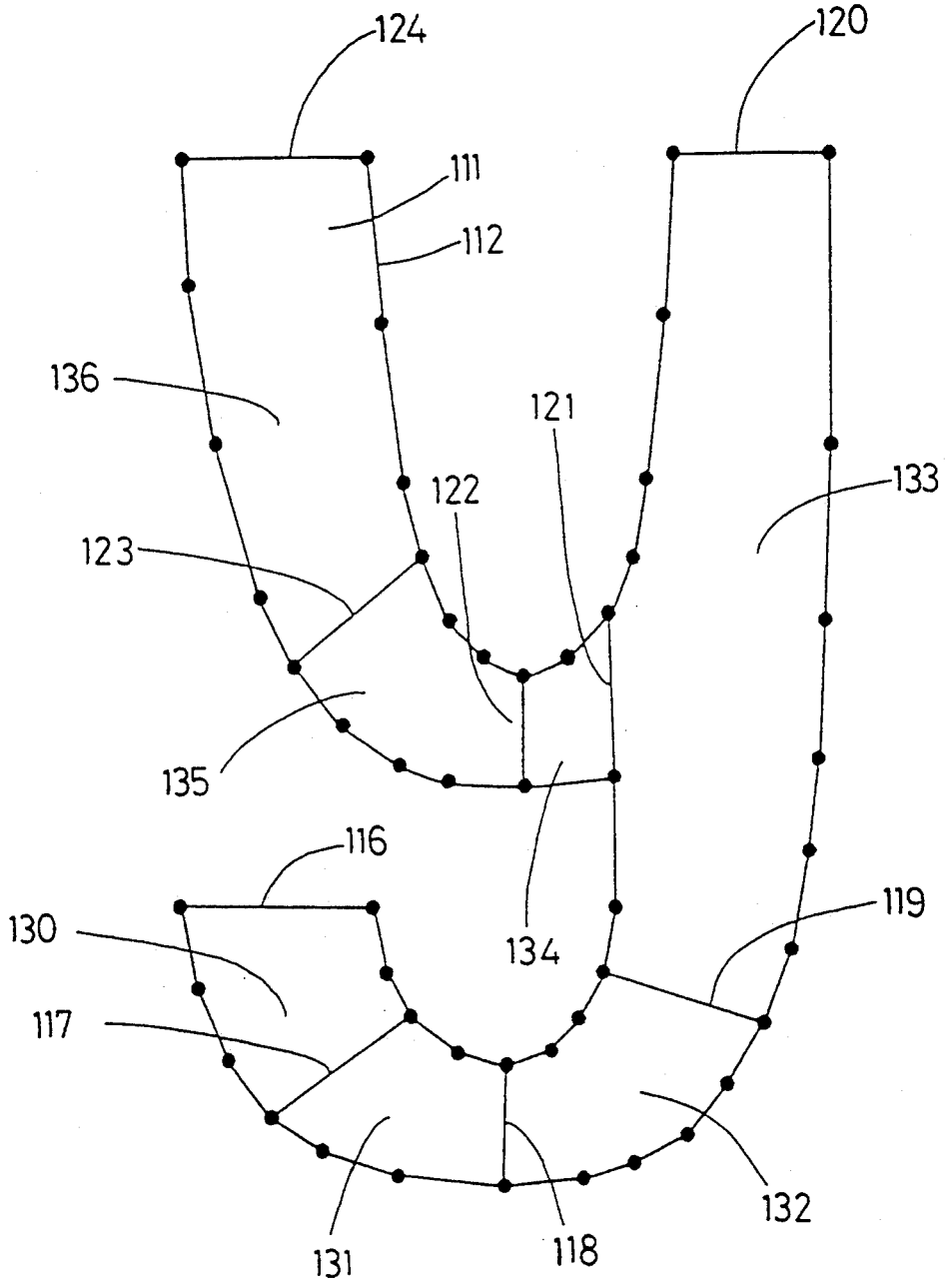
FIG. 11 is a view of assistance in explaining step S6 of the embroidery data producing program of FIGS. 4A and 4B.

In step S4, the desired stitching line segments are used as stitch dividing line segments to divide the embroidering area 111 into a plurality of first embroidering sections. For example, suppose that nine desired stitching line segments 116, 117, 118, 119, 120, 121, 122, 123 and 124 have been set for the embroidering area 111 as shown in FIG. 11. Then, the desired stitching line segments 117 to 119 and 121 to 123 are used as stitch dividing line segments to divide the embroidering area 111 into seven first embroidering sections 130, 131, 132, 133, 134, 135 and 136.

The desired stitching line segments 116, 120 and 124, on the contour 112 of the embroidering area 111, are not used for dividing the embroidering area 111. Further, desired stitching line segments each having the extreme points on the same point are not used for dividing the embroidering area 111.

In step S5, reference points 0 are determined respectively for each of the first embroidering sections.

Two stitching direction determining lines are determined for each first embroidering section. The reference point 0 is the intersection point of the two stitching direction determining lines. The number of the stitch dividing line segments corresponding to each first embroidering section is not necessarily two; the number may be one, three or more than three. Each of the first embroidering sections 131, 132, 134 and 135 of the embroidering area two stitch dividing line segments. However, for example, where one of the desired stitching line segments is an outline segment and a second desired stitching line segment is set for defining an embroidering area, the embroidering area is divided into two first embroidering sections each having a single desired stitching line segment, but at least one of the two first embroidery sections has only one stitch dividing line (sections 130 and 136 in FIG. 11) whereas the first embroidering section 133 of the embroidering area 111 has two stitch dividing line segments of the three desired stitching line segments. Accordingly, the method of determining the stitching direction determining line is dependent on the number of the stitch dividing line segments. To reduce confusion, from this point on in the discussion, all desired stitching line segments designated by the operator will be defined to be dividing line segments.

Three methods of determining the stitching direction determining line respectively for a first case where one stitch dividing line segment is set for the first embroidering section, a second case where two stitch dividing line segments are set for the first embroidering section and a third case where three or more stitch dividing line segments are set for the first embroidering section will be described hereinafter.

Figure 12:
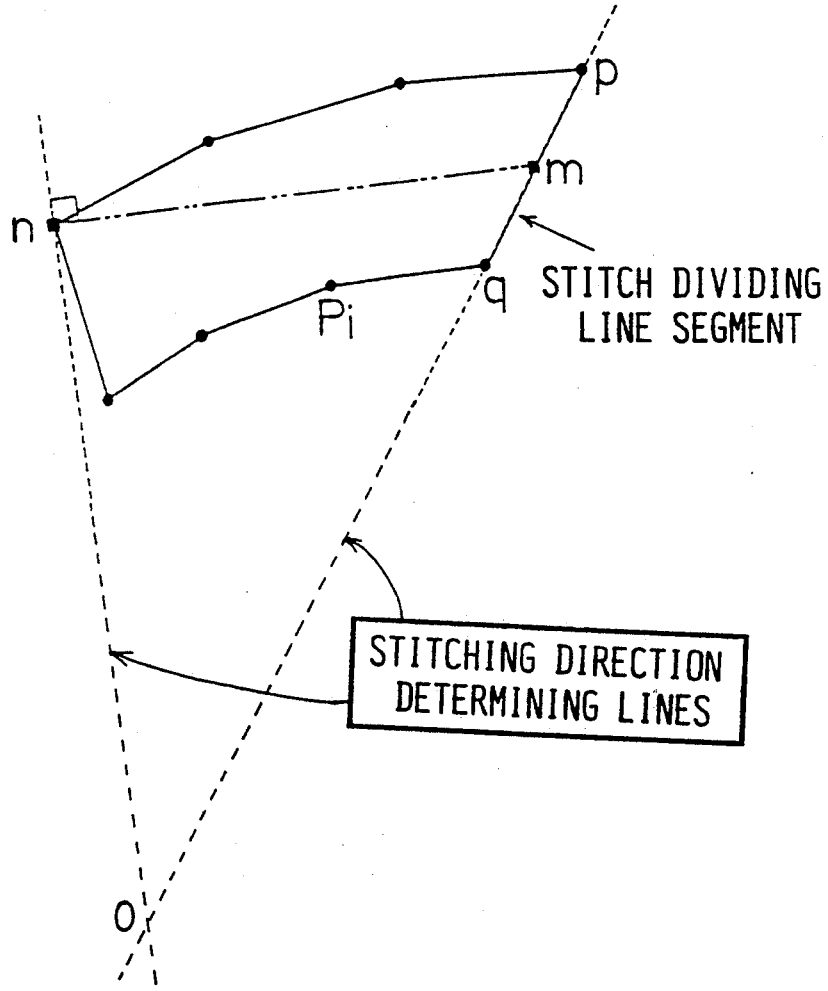
FIG. 12 is a view of assistance in explaining step S5 of the embroidery data producing program of FIGS. 4A and 4B.

Referring to FIG. 12, in the first case where a single stitch dividing line segment is set, a straight line including the stitch dividing line segment pq is chosen as a stitching direction determining line, and then a vertex n, farthest from the middle point m of the stitch dividing line segment pq, among the vertices of the first embroidering section is selected. Then, a straight line connecting the middle point m and the vertex n is determined and a straight line perpendicular to the straight line connecting the middle point m and the vertex n and passing through the vertex n is selected as another stitching direction determining line.

As a special case, there may be two desired stitching line segments set for the first embroidering section, it is considered that only one stitch dividing line segment is provided for the first embroidering section if one of the desired stitching line segments has both of its end points as one point (vertex) and this point is the vertex n, i.e. there is no true desired stitching line segment between the designated end points. The desired stitching line segment can be set for deciding the vertex n.

Figure 13:
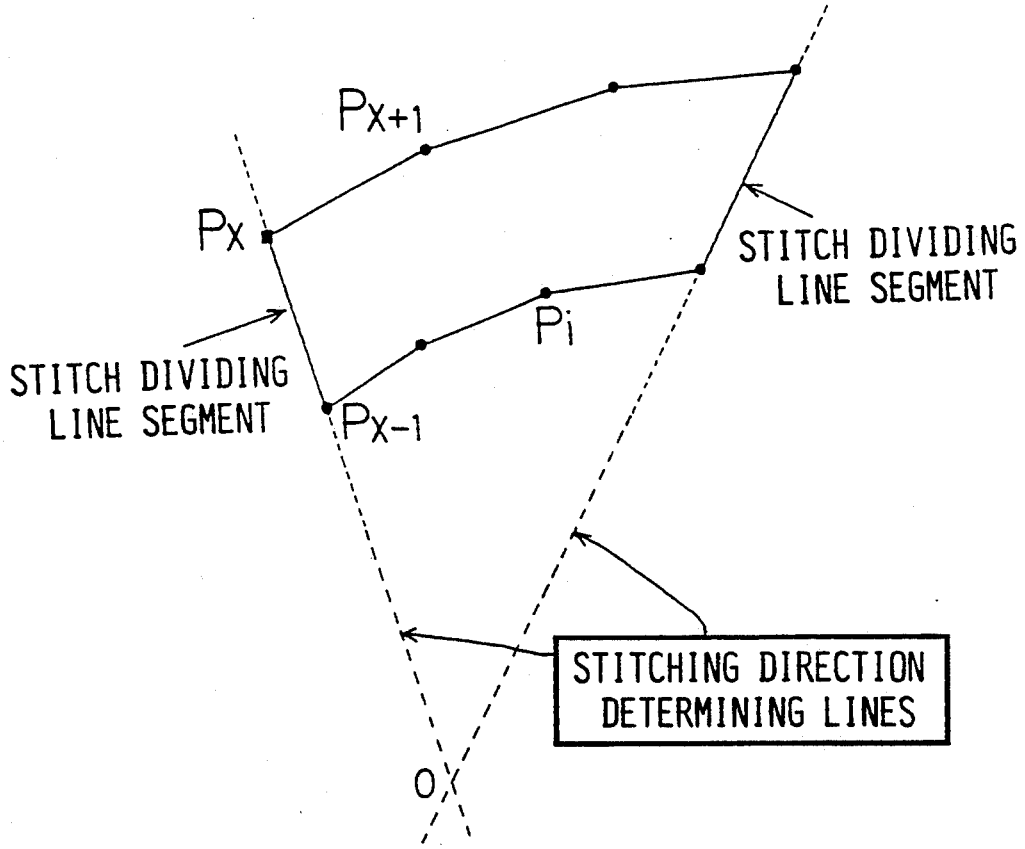
FIG. 13 is a view of assistance in explaining step S5 of the embroidery data producing program of FIGS. 4A and 4B.

Referring to FIG. 13, in the second case where two stitch dividing line segments are set (such as first embroidery sections 130, 131, 132, 134, 135 and 136 in FIG. 11), two straight lines respectively including the two stitch dividing line segments are themselves the stitching direction determining lines.

Figure 14:
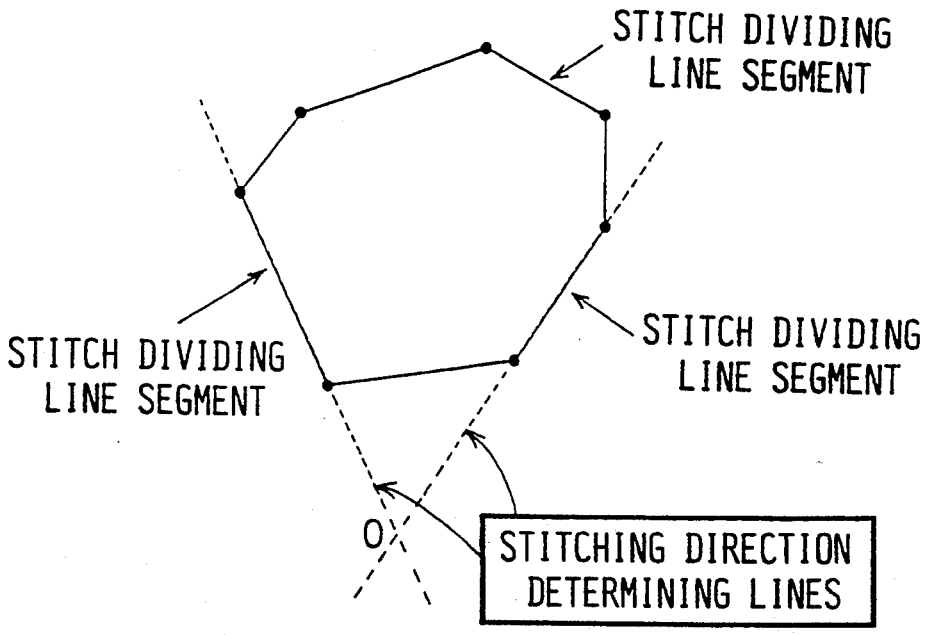
FIG. 14 is a view of assistance in explaining step S5 of the embroidery data producing program of FIGS. 4A and 4B.

Referring to FIG. 14, in the third case where three stitch dividing line segments are set (such as first embroidering section 133 in FIG. 11), lines respectively including two optional stitch dividing line segments among the three stitch dividing line segments are selected as stitching direction determining lines. The two stitch dividing line segments among the three or more stitch dividing line segments may be those farthest from each other or may be the stitch dividing line segment set first and the stitch dividing line segment set second.

In step S6 (FIGS. 4A and 4B), each first embroidering section is divided into second embroidering sections so that none of the contours of the second embroidering sections are externally concave. Step S6 is the subroutine shown in FIGS. 6A and 6B.

Figure 6A:
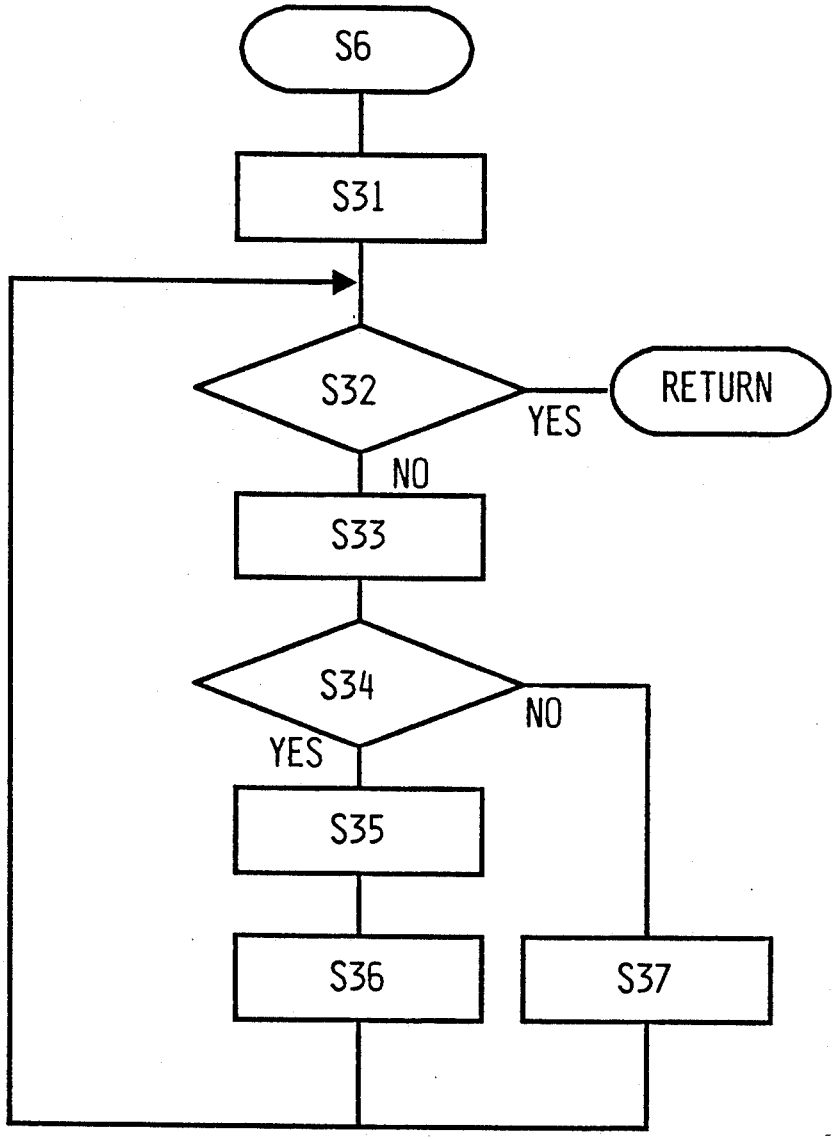
FIG. 6A is a flow chart of a subroutine to be executed in step S6 of the embroidery data producing program of FIGS. 4A and 4B.

Referring to FIGS. 6A and 6B, data defining each of the first embroidering sections, such as vertex data, is put onto the division stack in the division stack storage area 72 in step S31. In step S32, a query is made to see if the division stack is empty. If the response in step S32 is No, the last number data is fetched from the division stack and the first embroidering section corresponding to the last number data is selected. In step S33, it is decided whether the data representing the vertices of the contour data of the selected first embroidering section are arranged clockwise or whether the same are arranged counterclockwise. Specifically, a vertex Px having the least X coordinate among the vertices of the contour is selected, and the respective Y coordinates of the succeeding vertex Px+1, i.e., a vertex having a memory address greater by one than that of the vertex Px, and the preceding vertex Px−1, i.e., a vertex having a memory address smaller by one than that of the vertex Px, are compared. If the Y coordinate of the vertex Px+1 is greater than that of the vertex Px−1, it is decided that the data representing the vertices are arranged clockwise. If the Y coordinate of the vertex Px+1 is smaller than that of the vertex Px−1, it is decided that the data representing the vertices are arranged counterclockwise.

In step S34, each of the vertices of the first embroidering section are examined to see if the vertex is an externally concave point.

Figure 15:
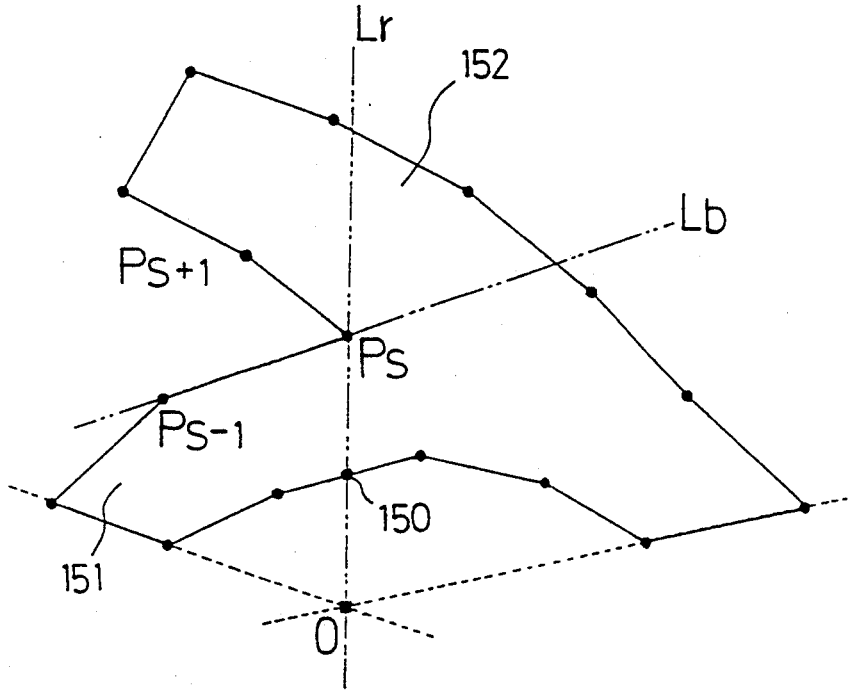
FIG. 15 is a view of assistance in explaining step S6 of the embroidery data producing program of FIGS. 4A and 4B.

Specifically, a straight line Lr is determined so as to pass through the reference point 0 determined in step S5 and the objective vertex Ps as shown in FIG. 15, and a query is made to see if both the succeeding vertex Ps+1 and the preceding vertex Ps−1 are in one of the sectors of the X-Y coordinate plane partitioned by the straight line Lr. If the response is affirmative, the vertex Ps is an inverting point.

When it is decided that the vertex Ps is an inverting point, a straight line Lb passing the vertex Ps and the preceding vertex Ps−1 is determined. When the contour data representing the contour of the first embroidering section are stored clockwise, the vertex Ps is an externally concave point if the succeeding vertex Ps+1 is on the left-hand side of the straight line Lb as viewed from the preceding vertex Ps−1 or the vertex Ps is an externally convex point if the succeeding vertex Ps+1 is on the right-hand side of the straight line Lb as viewed from the preceding vertex Ps−1. When the contour line representing the contour of the first embroidering section are stored counterclockwise, the vertex Ps is an externally concave point if the succeeding vertex Ps+1 is on the right-hand side of the straight line Lb or the vertex Ps is an externally convex point if the succeeding vertex Ps+1 is on the left-hand side of the straight line Lb. Criteria for deciding whether the vertex Ps is an externally concave point or whether the same is an externally convex point are tabulated in a table shown in FIG. 16.

If the objective vertex Ps is an externally concave point, all the intersection points of the straight line Lr and the contour are determined in step S35. If there are a plurality of intersection points, the intersection point nearest to the externally concave vertex is selected as a dividing point 150, and the first embroidering section is divided into two embroidering sections 151, 152 by a line connecting the dividing point and the externally concave vertex. The two embroidering sections are put onto the division stack as new first embroidering sections because it is possible there are externally concave vertices in the new first embroidering sections.

When the objective vertex Ps is not an externally concave point, the succeeding vertex Ps+1 is selected as an objective vertex Ps for the next decision. The same deciding procedure is repeated for the new objective vertex Ps.

If it is been decided that none of the vertices of the first embroidering section is an externally concave point, the contour data representing the contour of the first embroidering section is stored in the contour data storage area 74 in step S37. The first embroidering section is stored as a second embroidering section not having any externally concave points.

Thus, steps S32 to S37 are executed repeatedly until the division stack becomes empty. Then, the response in step S32 is affirmative and one cycle of the subroutine is ended.

After the second embroidering sections, which do not have any externally concave points, have thus been determined, embroidery data necessary for covering each second embroidering section with stitches is produced. Each second embroidering section is divided into a plurality of blocks. Then, the two sides opposite to each other with respect to a direction perpendicular to the direction of advancement of embroidering among the four sides of each quadrangular block are connected alternately to determine stitching points on the work W where the needle 18 of the automatic sewing machine penetrates the work W in embroidering.

The step of dividing each second embroidering section into a plurality of blocks and producing block data representing the blocks and the step of producing stitching point data representing the stitching points are executed separately. Only the block data producing procedure is executed when an embroidery data producing instruction is given by the operator, and only the stitching point data producing procedure is executed on the basis of the block data produced by the block data producing procedure when an embroidering start instruction is given by the operator. That is, the block data is used as embroidery data when only an embroidery data producing instruction is given and the stitching point data is used as embroidery data when both the embroidery data producing instruction and the embroidering start instruction is given.

Figure 7A:
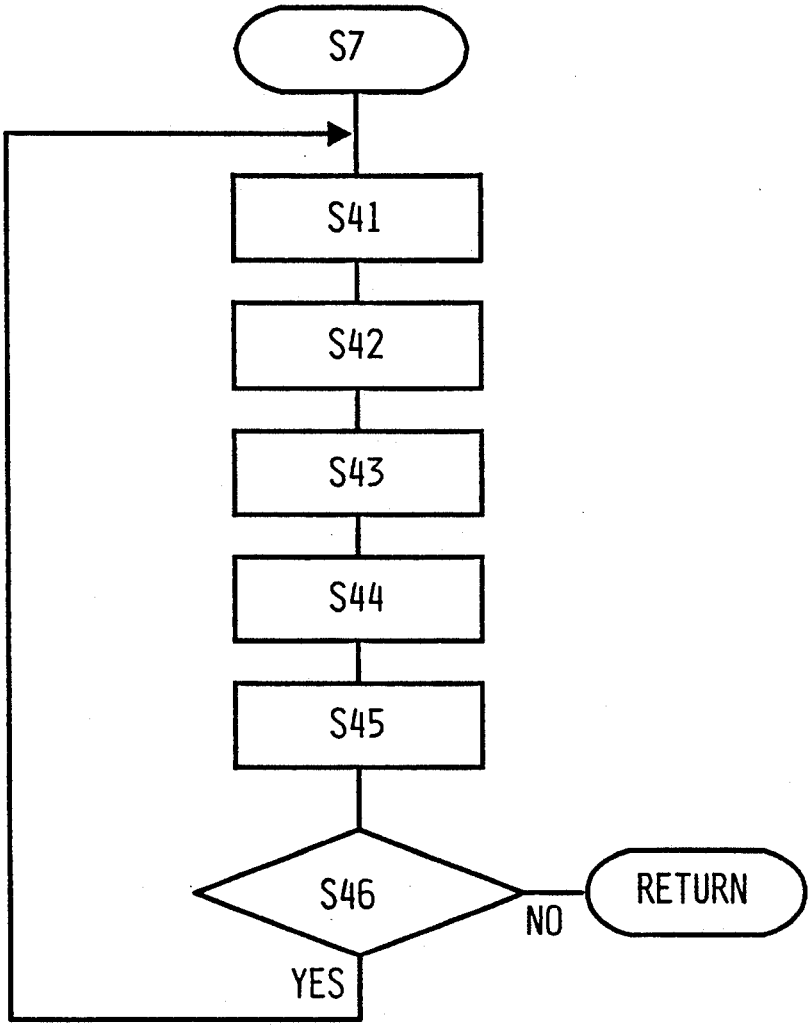
FIG. 7A is a flow chart of a subroutine to be executed in step S7 of the embroidery data producing program of FIGS. 4A and 4B.

In this case, when only the embroidery data producing instruction is given, the block data produced in step S7 is used as embroidery data. A subroutine to be executed in step S7 is shown in FIGS. 7A and 7B.

Figure 17:
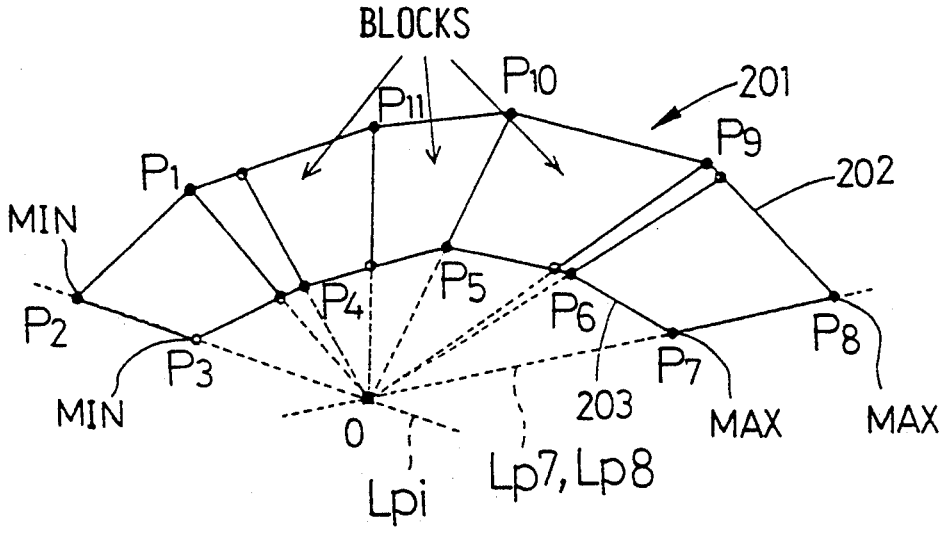
FIG. 17 is a view of assistance in explaining step S7 of the embroidery data producing program of FIGS. 4A and 4B.

In step S41, the partial contour data representing the contour of the second embroidering section 201 (FIG. 17) is read from the partial contour data storage area 74. In step S42, a plurality of straight lines Lpi (i=1 to 11) each of which passes through the reference point O of the second embroidering section 201, i.e., the reference point O of the first embroidering section is also the reference point O of the second embroidering section 201, and the corresponding vertices Pi (i=1 to 11) of the contour of the second embroidering section 201 as shown in FIG. 17 are determined. In step S43, the vertices Pi meeting a condition that both the vertex Pi+1 preceding the vertex Pi and the vertex Pi−1 succeeding the vertex Pi are in one of the two sectors of the X-Y coordinate plane divided by the straight line Lpi. Then, the two vertices farthest from each other on an arc having its center at the reference point O and approximate to the second embroidering section 201 among the vertices of the second embroidering section 201 are determined. The respective positions of these two vertices are a point MAX and a point MIN. The contour of the second embroidering section 201 is divided into two partial contours 202 and 203 by the points MAX and MIN.

When the straight line Lp7 passing the vertex P7 and the reference point O, and the straight line Lp8 passing the vertex P8 and the reference point O are aligned as shown in FIG. 17, the line segment P7P8 is considered to belong to neither the partial contour 202 nor the partial contour 203. In such a case, both the vertices P7 and P8 are the point MAX or the point MIN.

In step S44, the intersection points of the straight lines Lpi passing the vertices Pi, excluding the points MAX and MIN, and the reference point O, and the partial contour other than the partial contour having the vertices Pi are determined, and then, the second embroidering section 201 is divided into a plurality of blocks by line segments connecting the vertices and the corresponding intersection points. In step S45, block data as embroidery data representing the four vertices of each block is produced, and the block data is stored in the embroidery data storage area 76. In step S46, a query is made to see if there are any more second embroidering sections. If the response in step S46 is affirmative, the routine returns to step S41. If the response in step S46 is negative, one cycle of this subroutine is completed.

Figure 18:
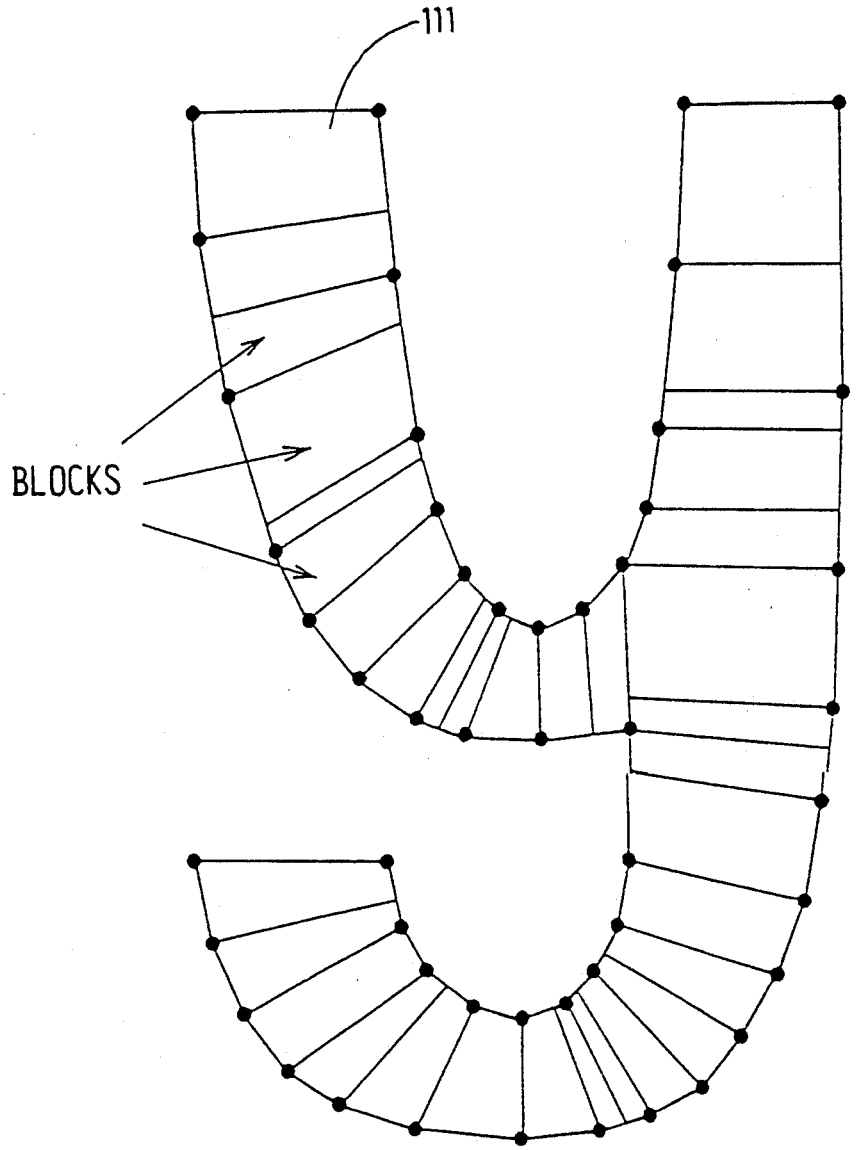
FIG. 18 is a view of assistance in explaining the division of the embroidering area shown in FIG. 9 into a plurality of blocks.

Thus, the block data representing the plurality of blocks shown in FIG. 18 are produced for the embroidering area 111.

Figure 19:
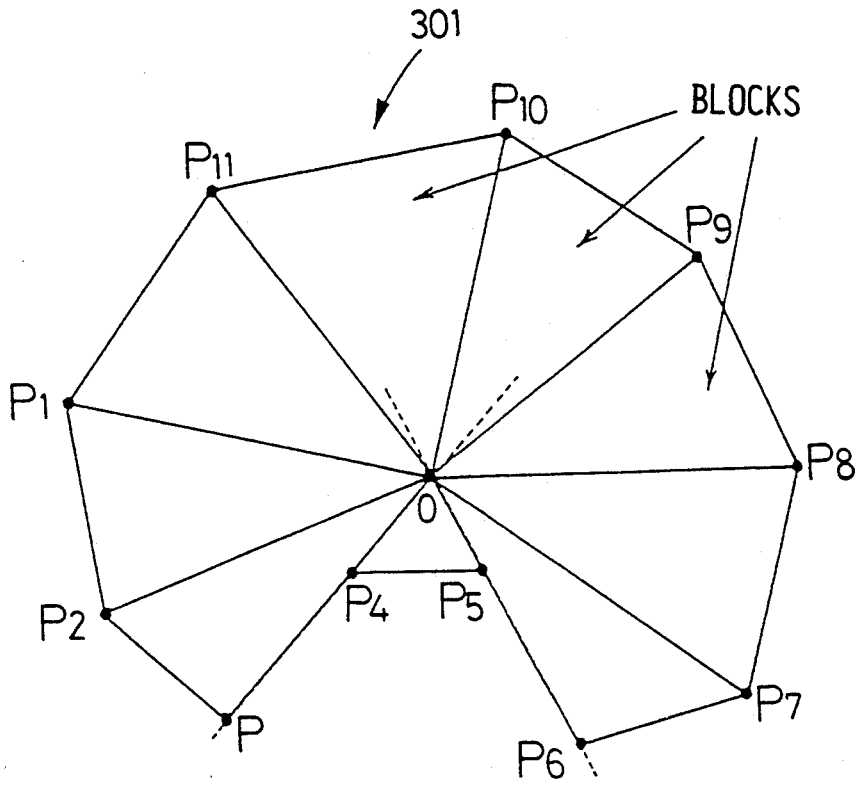
FIG. 19 is a view of assistance in explaining the division of a second embroidering section into a plurality of blocks.

The procedure shown in FIGS. 7A and 7B is effective provided that the reference point O of the second embroidering section is located outside the second embroidering section. The second embroidering section cannot be divided into a plurality of blocks by the procedure shown in FIGS. 7A and 7B if the reference point O is located within the second embroidering section. If a second embroidering section 301 having the reference point 0 therein, as shown in FIG. 19, needs to be divided properly into blocks, the second embroidering section 301 is divided into blocks by line segments extending between the vertices Pi (i=1 to 11) and the reference point O as shown in FIG. 19.

In step S8, the embroidery data is transferred from the embroidery data storage area 76 to the external storage device 54, and the main routine for producing the embroidery data is completed.

Figure 20:
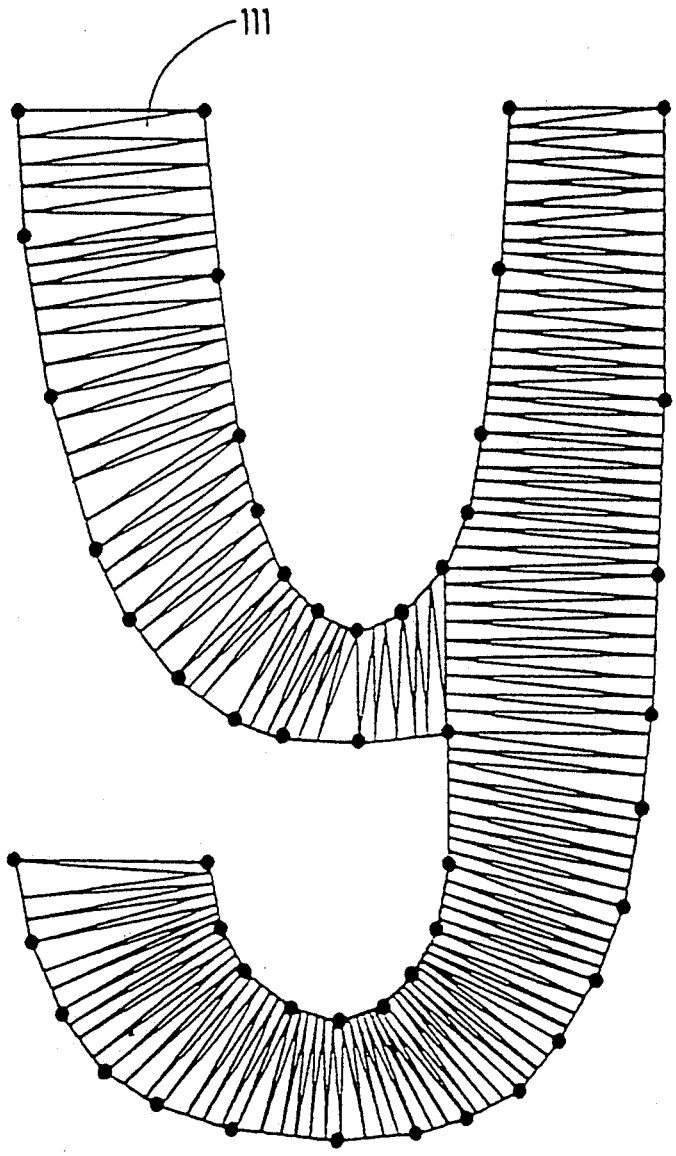
FIG. 20 is a view of assistance in explaining stitches formed in the embroidering area shown in FIG. 9.

When an embroidering start instruction is given by the operator after the embroidery data has been stored in the external storage device 54, stitching point data representing stitching points necessary for forming stitches in the embroidering area 111, as shown in FIG. 20, is produced on the basis of the block data stored in the external storage device 54, and then, the automatic sewing machine operates according to the stitching point data to cover the embroidering area with stitches.

The stitching point data may be produced from the block data by any suitable procedure. For example, the stitching point data may be produced by a procedure that determines a pitch along a straight line corresponding to a yarn density representing the density of stitches, and determines the locations of stitching points from the pitch and the shape of the block or the stitching point data may be produced by a procedure that determines an angular interval corresponding to yarn density for each block and locates stitching points respectively at the intersection points of straight lines radially extending from the reference point at the angular interval and the contour of the embroidering section.

However, when the stitching point data is produced by either of these two procedures, the yarn density on the outer side of the contour of the embroidering section and the yarn density on the inner side of the contour of the embroidering section differ greatly from each other if the radius of curvature of the outer side of the contour is far greater than that of the inner side of the contour. To avoid forming such an undesirable embroidery, it is desirable to set an appropriate number of intermediate stitching points within the embroidering section between the outer side and inner side of the contour of the embroidering section and to reduce the number of stitching points on the inner side of the contour relative to the number of stitching points on the corresponding outer side of the contour.

In this embodiment, when an embroidering area is divided into two embroidering sections by a single desired stitching line, a reference point is determined for each embroidering section and each embroidering section is divided into a plurality of blocks by using the reference point. However, it is also possible, when only a single desired stitching line is set for an embroidering area, to divide the embroidering area into a plurality of blocks by a plurality of straight lines respectively passing the vertices of the contour of the embroidering area and extending in parallel to the desired stitching line. When the operator desires to cover an embroidering area by stitches parallel to a desired stitching line, only a single desired stitching line is set.

In this embodiment, a single reference point is determined in common for the second embroidering sections, i.e., the divisions of the first embroidering section, and the same stitching directions are set for the second embroidering sections. However, it is possible, as stated in Japanese Patent Laid-open No. Hei 1-266546, to set different stitching directions respectively for the second embroidering sections.

In this embodiment, an embroidering area is divided into quadrangular blocks each defined by four line segments. It is also possible to divide the embroidering area into blocks each defined by two line segments and two curvilinear segments.

Incidentally, the procedure of determining the reference point from a single desired stitching line and the contour of the first embroidering section, dividing the first embroidering section into the second embroidering sections by using the reference point and dividing each second embroidering section into blocks by using the reference point when only a single desired stitching line is determined can be carried out also by an embroidery data processing system capable of setting only a single representative desired stitch as well as by an embroidery data processing system capable of setting a plurality of representative desired stitches for an embroidering area.

Although the invention has been described in its preferred form with a certain degree of particularity, obviously many changes and variations are possible therein. It is therefore to be understood that the present invention may be practiced otherwise than as specifically described herein without departing from the spirit and scope thereof.

What is claimed is:

1. An embroidery sewing apparatus with a data processing system, comprising:

contour data storage means for storing contour data representing the contour of an embroidering area to be covered with a plurality of stitches formed by a sewing machine;

embroidering area display means for displaying the embroidering area on the basis of the contour data;

representative desired stitch setting means for permitting an operator to set the position and direction in the embroidering area of at least one representative desired stitch among a plurality of stitches to be formed by the sewing machine in the embroidering area;

embroidery data producing means for producing embroidery data necessary for covering the embroidering area with stitches on the basis of representative desired stitch data representing the at least one representative desired stitch and the contour data;

embroidery data storage means for storing the embroidery data; and sewing means for using the stored embroidery data to sew stitches in the embroidery area.

2. The embroidery data processing system according to claim 1, wherein the embroidery data producing means includes embroidering area dividing means for dividing the embroidering area into a plurality of embroidering sections by desired stitching lines respectively corresponding to the at least one representative desired stitch.

3. The embroidery data processing system according to claim 2, wherein the embroidering area dividing means is a first dividing means, and the embroidering sections formed by dividing the embroidering area by the first dividing means are first embroidering sections, and the embroidery data producing means comprises the first dividing means and a second dividing means for dividing the first embroidering sections formed by dividing the embroidering area by the first dividing means to produce contours of all the second embroidering sections that are convex.

4. The embroidery data processing system according to claim 3, wherein the second dividing means divides the first embroidering section into the second embroidering sections by straight lines passing a reference point at which the respective extensions of two desired stitching line segments corresponding to the first embroidering section intersect each other and the contour determining points determining the contour of the first embroidering section so that respective contours of the second embroidering sections are convex on the straight lines passing the reference point and the contour determining points determining the contours of the second embroidering sections.

5. The embroidery data processing system according to claim 2, wherein the embroidery data producing means further comprises blocking means for dividing each of the embroidering sections formed by dividing the embroidering area by the embroidering area dividing means into a plurality of blocks by a plurality of straight lines passing the reference point at which the respective extensions of two desired stitching line segments corresponding to each embroidering section intersect each other and the contour determining points on the contour of the embroidering section.

6. The embroidery data processing system according to claim 2, wherein the embroidery data producing means further comprises blocking means for dividing each of the embroidering sections formed by dividing the embroidering area by the embroidering area dividing means into a plurality of blocks by a plurality of straight lines passing the reference point at which the extension of a single desired stitching line segment corresponding to each embroidering section and a straight line determined from the desired stitching line segment and the contour of each embroidering section intersect each other, and the contour determining points on the contour of each embroidering section.

7. A method for establishing and using a stitching pattern with an embroidering machine, comprising the steps of:

reading pattern contour data from an external storage device;

storing the pattern contour data in a contour data storage area;

displaying a contour on the basis of the pattern contour data on a display device;

setting at least one desired stitching line segment to establish a stitching direction;

dividing an embroidering area defined by the pattern contour data into first embroidering sections using stitch dividing line segments corresponding to desired stitching line segments;

determining a reference point for each of the first embroidering sections;

subdividing each first embroidering section into second embroidering sections having no externally concave points;

producing embroidery sewing data from the second embroidering sections;

storing the embroidery sewing data in the external storage device; and sewing the stitching pattern in accordance with the stored embroidery sewing data.

8. The method as claimed in claim 7, wherein the step of setting at least one desired stitching line segment further comprises the steps of:

setting a first extreme point of the desired stitching line segment; and setting a second extreme point of the desired stitching line segment wherein the first and second extreme points are selected from among the vertices defining a contour of the embroidering area.

9. The method as claimed in claim 8, further comprising the step of determining whether one of the desired stitching line segment connecting the first extreme point and the second extreme point is included within the embroidering area and whether the desired stitching line segment connecting the first extreme point and the second extreme point crosses a previously set desired stitching line segment.

10. The method as claimed in claim 9, further comprising the steps of:

not permitting the designation of the desired stitching line segment if one of the group consisting of the desired stitching line segment extending outside of the embroidering area and the desired stitching line segment intersects a previously set desired stitching line segment occurs; and storing the desired stitching line segment in a line data storage area when the desired stitching line segment is appropriate.

11. The method as claimed in claim 7, wherein the step of determining a reference point for a first embroidering section having a single stitch dividing line segment further comprises the steps of:

designating the stitch dividing line segment as a first stitching direction determining line;

extending the first stitching direction determining line outside of the embroidering area;

identifying a midpoint between a first extreme point and a second extreme point of the stitch dividing line segment;

identifying a vertex in the first embroidering section furthest from the midpoint;

drawing a first straight line connecting the midpoint and the vertex;

drawing a second straight line perpendicular to the first straight line and passing through the vertex, the second straight line being designated a second stitching direction determining line; and identifying the point of intersection of the first stitching direction determining line and the second stitching direction determining line, the intersection being the reference point.

12. The method as claimed in claim 7, wherein the step of determining the reference point when there are two stitch dividing line segments comprises the steps of:

extending the two stitch dividing line segments outside the embroidering area;

designating the two stitch dividing line segments as stitching direction determining lines;

determining a point of intersection of the two stitching direction determining lines; and identifying the point of intersection as the reference point.

13. The method as claimed in claim 7, wherein the step of determining the reference point when there are three stitch dividing line segments further comprises the steps of:

selecting two of the stitch dividing line segments to be stitching direction determining lines;

extending the two stitching direction determining lines so they intersect at a point; and identifying the point as the reference point.

14. The method as claimed in claim 7, wherein the step of dividing the first embroidering sections by using inverting points further comprises the steps of:

determining an order in which vertex data for the first embroidery section is stored;

using the order in which the vertex data is stored to determine whether any vertex is an externally concave point; and dividing said the first embroidery section into second embroidery sections having no concave points.

15. The method as claimed in claim 14, wherein vertex data used for determining the storing sequence is stored in a division stack of a division stack storage area for each defined first embroidery section and further comprising the steps of:

determining whether the division stack is empty prior to the step of determining an order; and following the step of dividing the first embroidery section into second embroidery sections, storing the second embroidery sections in a partial contour data storage area.

16. The method as claimed in claim 7, wherein the step of producing embroidery sewing data further comprises the steps of:

reading second embroidering sections data from a partial contour data storage area;

defining straight lines passing through the reference point and each vertex of the second embroidery section;

determining two partial contours providing edges for a stitching area; and identifying intersection points of the straight lines passing through the vertices and the reference point to create line segments between the partial contours such that the line segments and the partial contours divide the second embroidering sections into a plurality of blocks.

17. A method for producing embroidery data for use in an embroidering machine, comprising the steps of:

displaying an embroidering area to be covered with a plurality of stitches formed by the embroidering machine, the embroidering area being defined by contour data representing a contour;

inputting by an operator of a position and direction in the embroidering area of at least one representative desired stitch among a plurality of stitches to be formed by the embroidering machine in the embroidering area;

producing embroidery data necessary for covering the embroidering area with stitches on the basis of representative desired stitch data representing the at least one representative desired stitch and the contour data;

storing the embroidery data produced; and using the embroidery data to stitch the embroidering area.

18. The method as claimed in claim 17, wherein the step of producing embroidery data includes the steps of:

dividing the embroidering area into a plurality of embroidering sections by desired stitching lines respectively corresponding to the at least one representative desired stitch.

19. The method as claimed in claim 18, wherein the step of dividing the embroidering area includes the step of:

dividing the embroidering area into a plurality of first embroidering sections;

and the step of producing embroidery data further includes the step of:

dividing each of the first embroidering sections into a plurality of second embroidering sections to produce contours of all the second embroidering sections that are convex.

20. The method as claimed in claim 18, wherein the step of producing embroidery data further comprises the step of:

further dividing each of the embroidering sections formed by dividing the embroidering area into a plurality of blocks by means of a plurality of straight lines passing through a reference point at which respective extensions of two each embroidering sections intersect each other and the contour determining points on the contour of the embroidering section.

* * * * *